United States Patent [19]

Barendregt et al.

[11] Patent Number: 4,786,913

[45] Date of Patent: Nov. 22, 1988

[54] UNIVERSAL WAVEGUIDE JOINT, FLEXIBLE COUPLER, AND ARRANGEMENT FOR A SURVEILLANCE RADAR ANTENNA

[75] Inventors: Albertus J. Barendregt, Diepenheim; Marcellis J. A. Van Der Kemp, Hengelo, both of Netherlands

[73] Assignee: 501 Hollandse signaalapparaten B.V., Henglo, Netherlands

[21] Appl. No.: 853,790

[22] Filed: Apr. 18, 1986

[30] Foreign Application Priority Data

May 1, 1985 [NL] Netherlands ..... 8501233

[51] Int. Cl.[4] ..... H01Q 3/00

[52] U.S. Cl. ..... 343/765; 343/762; 333/248; 333/249

[58] Field of Search ..... 343/757, 762, 765, 772; 333/248, 249

[56] References Cited

U.S. PATENT DOCUMENTS

| | | | |
|---|---|---|---|
| 2,428,001 | 9/1947 | Tubbs | 333/243 |
| 2,519,933 | 8/1950 | Rovault | 174/21 |
| 2,632,807 | 3/1953 | Kirkpatrick et al. | 178/44 |
| 2,706,279 | 4/1955 | Aron | 333/98 |
| 2,956,248 | 10/1960 | Strand | 343/757 |
| 4,647,939 | 3/1987 | Kolhoff | 343/765 |

FOREIGN PATENT DOCUMENTS 1006861 10/1965 United Kingdom .

*Primary Examiner*—William L. Sikes
*Assistant Examiner*—Le Hoanganh
*Attorney, Agent, or Firm*—Robert J. Kraus

[57] ABSTRACT

Universal waveguide joint, provided with at least two waveguide segments (1–7) slidable over each other, whereby one end of at least one of the waveguide segments (1–7) has a convex surface and the end of another respective waveguide segment, slidable over said convex surface, a concave surface.

16 Claims, 12 Drawing Sheets

UNIVERSAL WAVEGUIDE JOINT, FLEXIBLE COUPLER, AND ARRANGEMENT FOR A SURVEILLANCE RADAR ANTENNA

BACKGROUND OF THE INVENTION

The invention relates to a universal waveguide joint, provided with at least two waveguide segments slidable over each other, to a flexible waveguide coupler derived from the universal waveguide joint in an embodiment according to the invention, and to an arrangement for a surveillance radar antenna, in which arrangement the flexible waveguide coupler finds specific application according to the invention.

Universal waveguide joints are of prior art; in EP-A-No. 0.147.900, FIG. 4 depicts a waveguide joint, in which the combination of several waveguide segments is so arranged that through the use of two stepped twisters the input waveguide segment is movable relatively to the output waveguide segment about two mutually perpendicular axes lying in a plane perpendicular to the direction in which further waveguides are connected to the universal waveguide joint.

A universal waveguide joint may be incorporated in an arrangement for a vehicle- or vessel-borne surveillance radar antenna, provided with a two-axis, gimbal system mounted on the vehicle or vessel, and with a platform suspended by the gimbal system, which platform can be stabilised about the mutually orthogonal axes of the gimbal system with respect to an earth-fixed reference position, whereby the surveillance radar antenna is mounted rotatably about an axis perpendicular to the platform, while a mechanical, universal joint transmits the rotational motion produced by a drive mechanism, mounted directly on the vehicle or vessel, to the surveillance radar antenna; the universal waveguide joint is incorporated in the waveguide channel for transmitting the r.f. energy between a transmitting and receiving unit, mounted directly on the vehicle or vessel, and the antenna.

The orthogonal axes of both the mechanical and the universal waveguide joints are rotatable in the plane through the axes of the gimbal system. In the surveillance radar antenna arrangement described in the cited patent publication the waveguide channel including the universal waveguide joint bypasses the mechanical joint entirely, whereby the universal waveguide joint takes up relatively much space. Consequently the gimbal system, by which the platform is suspended, is of a relatively large size and hence of a heavy construction.

SUMMARY OF THE INVENTION

The present invention has for its object to provide a universal waveguide joint used for obtaining a flexible waveguide coupler, by which the above disadvantages are obviated when applied in an arrangement for a surveillance radar antenna of the type described above. More generally, the object of the present invention is to provide a universal waveguide joint of a simple construction, which is relatively inexpensive and suitable for obtaining a flexible coupler, whereby more particularly the rotational motion is transmitted homokinetically.

According to the invention, the universal waveguide joint, containing at least two waveguide segments slidable over each other, is characterised in that one end of at least one of the waveguide segments has a convex surface and the end of another waveguide segment, which end is slidable over said convex surface, a concave surface.

The British patent specification No. 1,006,861, however, discloses a waveguide joint, containing three waveguide segments slidable over each other, whereby the two ends of the centre waveguide segment have a convex surface and the ends of the two outer waveguide segments, which inner ends are movable over said convex surface, a concave surface. In this patent specification the curved surfaces are cylindrical, permitting only a rotation motion in a single plane. Moreover, this rotational motion is very limited, namely to an angle corresponding with the thickness of the waveguide walls. Furthermore, chokes for preventing energy losses at the locations where the waveguide segments are slightly movable over each other are lacking. This waveguide joint does not lend itself for obtaining a homokinetic flexible waveguide coupler; surely, application in the above arrangement for a surveillance radar apparatus is impossible.

In a first embodiment of the universal waveguide joint both the convex and concave surfaces are spherical and, to obtain a larger universal angle of rotation, at least three consecutive waveguide segments slidable over each other, having a curvature oriented in the same direction, are incorporated. In particular, all waveguide segments have spherical surface with the same radius of curvature. Such an embodiment permits a mutually identical design of the waveguide segments; this is of great advantage from a production-engineering point of view. The two outer waveguide segments form obviously an exception to this. At one end these waveguide segments are cut square and provided with a flange to enable simple connection to other waveguides in the line. To obtain a proportional distribution of the total waveguide motion over the successive combinations of two waveguide segments slidable over each other, coupling mechanisms are incorporated, each of which mechanisms engaging the slides of three consecutive waveguide segments. It should be noted that the outer surface of the wall of the waveguide segments, provided they are not in a mutually twisted position, is preferably cylindrical. In a special embodiment, this coupling mechanism is constituted by three ball joints disposed at equal distances from the sides of three consecutive waveguide segments and connected to these sides and a connecting rod passing through the ball joints, whereby the centre ball joint is located at the height of the centre of the side of the middle segment of the thee consecutive waveguide segments and the two other ball joints at equal distances from the centre ball joint.

In a second embodiment of the universal waveguide joint, at least one of the waveguide segments has a convex surface at the two opposite ends, which waveguide segment constitutes in itself a centre waveguide segment, whereby at least a first and a second waveguide segment are rotatable with respect to the convex surfaces, such that the first waveguide segment is capable of rotation about a first axis and the second waveguide segment about a second axis perpendicular to the first axis. The universal movement so obtained can be achieved when the respective surfaces are either spherical or cylindrical. In both cases the curved surfaces have preferably a common centre of curvature, located in the middle of the centre waveguide segment. The universal waveguide joint in the second embodiment can be used to advantage if it is provided with a first series of at least two waveguide segments all capable of rotation about the first axis with respect to the centre waveguide segment, and a second series of at least two waveguide segments all capable of rotation about the second axis with respect to the centre waveguide segment, whereby a first and a second coupling mechanism are incorporated for obtaining a proportional distribution of the total waveguide movement over all waveguide segments, which coupling mechanisms engage with the sides of the waveguide segments of the first and the second series, respectively, are coupled to the centre waveguide segment, and are movable in planes parallel to the respective rotational plane of the waveguide segments of the first and the second series, respectively, with respect to the centre waveguide segment.

The universal waveguide joint according to the invention, in particular in the two embodiments, may very well be applied in obtaining a flexible waveguide coupler, whereby the rotational motion of one of the two outer waveguide segments about its axis is transmitted to the other outer waveguide segment. The universal waveguide joint is thereto accommodated in a gimbal system specially suited for this purpose. The two forks of the gimbal system are therefore connected to the two outer waveguide segments of the universal waveguide joint. In the first embodiment the gimbal system is however kinetically separated from the universal waveguide joint; in the second embodiment the gimbal system and the universal waveguide joint are fully integrated with each other.

A flexible waveguide coupler with a completely homokinetic transmission can be achieved by two interconnected universal waveguide joints, in particular in the second embodiment. In such a case, each of the universal waveguide joints has a separate gimbal system, while the two systems thus obtained are interconnected in a mirror position with respect to their connecting plane. In particular, the flexible waveguide coupler of the second embodiment is suitable for application in an arrangement for a surveillance radar antenna of the type described above, although a flexible waveguide coupler having a universal waveguide joint according to the first embodiment is by no means excluded.

BRIEF DESCRIPTION OF THE DRAWINGS

The invention and its advantages will now be described with reference to the accompanying drawing Figures, of which.

DESCRIPTION OF THE PREFERRED EMBODIMENTS

In the figures, like numerals represent like parts.

Figure 1:
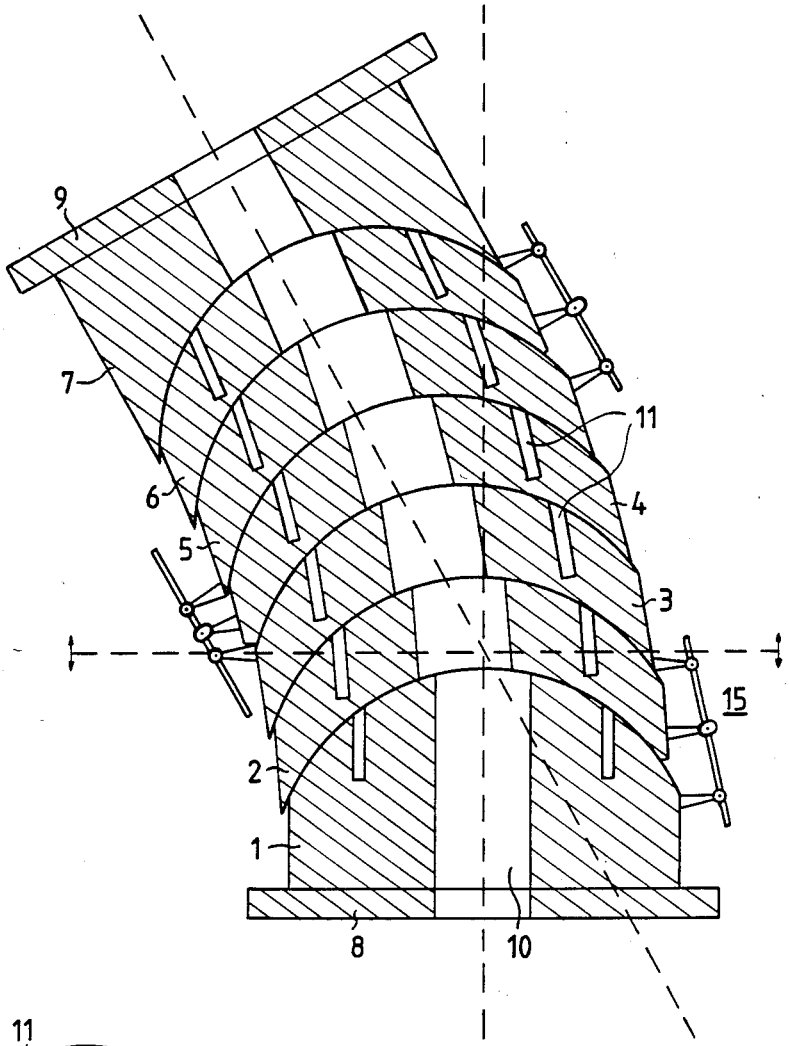
FIG. 1 is a diagram of a universal waveguide joint in a first embodiment according to the invention.

The universal waveguide joint in FIG. 1 consists of seven waveguide segments 1–7 movable relatively to each other. It will however be clear that it is also possible to use a different number, a depending factor being the desired rotations of the universal waveguide joint and the available space. Apart from the two outer waveguide segments 1 and 7, the waveguide segments are mutually identical and have both a convex and a concave surface, where all spherical surfaces are oriented in the same direction and have the same radius of curvature. Although it would suffice that each two spherical surfaces slidable over each other would have the same radius of curvature and this radius could differ for several pairs of such spherical surfaces, the waveguide segments however would be no longer equivalent, apart from the two outer segments; this must be regarded as a disadvantage from a production-engineering point of view. At one side the two extreme waveguide segments 1 and 7 have a convex and concave surface, respectively, with the same radius of curvature as that of the remaining waveguide segments and, at the other side, are cut square and provided with flanges 8 and 9 to facilitate connection to further waveguides. In case the waveguide segments 1 to 7 are placed straight on top of each other, they form a thick-walled cylinder, containing the waveguide channel 10. If r.f. energy is passed through waveguide channel 10, energy losses will be incurred at the positions where the spherical surfaces of the waveguide segments are slidable over each other. To prevent this, chokes 11 are inserted in the separate waveguide segments. The use of chokes is by itself of prior art and need not be further explained. It suffices to remark that the chokes in this application are disposed in a more or less angular arrangement in the convex surface of the waveguide segments.

Figure 2:
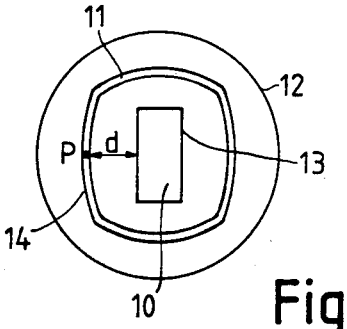
FIG. 2 is a top view of a single waveguide segment of the universal waveguide joint in the first embodiment.

FIG. 2 is a top view of a single waveguide segment; this figure shows the choke 14 situated between the circular outer edge 12 and the waveguide channel cross section 13. Although distance d of point P from the choke to the longitudinal side of cross section 13 is fixed to achieve proper operation of the choke, it should be kept in mind that, with the application of the angular choke, the relative movement of the waveguide segments may not result in a direct contact between the waveguide channel and the choke, particularly in the vicinity of the corners in the waveguide channel. This will limit the number of degrees of relative rotation between two waveguide segments in a certain direction. With the rotation of the consecutive waveguide segments in a certain direction, the end parts form protruding ridges in the waveguide channel, causing reflections and, hence, losses of r.f. energy. To limit this harmful effect, waveguide segments 2–6 are seized at $\frac{1}{4}\lambda$, where $\lambda$ is the wavelength of the r.f. energy to which the waveguide channel is tuned. Furthermore, the total waveguide movement has to be divided proportionally over the successive combinations of two waveguide segments slidable over each other; in such a case, the reflections against the protruding ridges are mutually more or less equal and since the waveguide segments have a length of $\frac{1}{4}\lambda$, the reflections will for the greater part damp out each other. Such a proportional distribution of the total waveguide movement is achieved by coupling mechanism 15, each mechanism engaging the sides of three consecutive waveguide segments. In a special embodiment such a coupling mechanism 15 is constituted by three ball joints 16, 17 and 18, located at equal distances from the sides of three successive waveguide segments and connected with these sides, and a connecting rod 19 passing through the ball joints, whereby the centre ball joint 17 is at the height of the centre of the side in the middle of the three consecutive waveguide segments and the two other ball joints 16 and 18 at equal distances from the centre ball joint 17.

Figure 3:
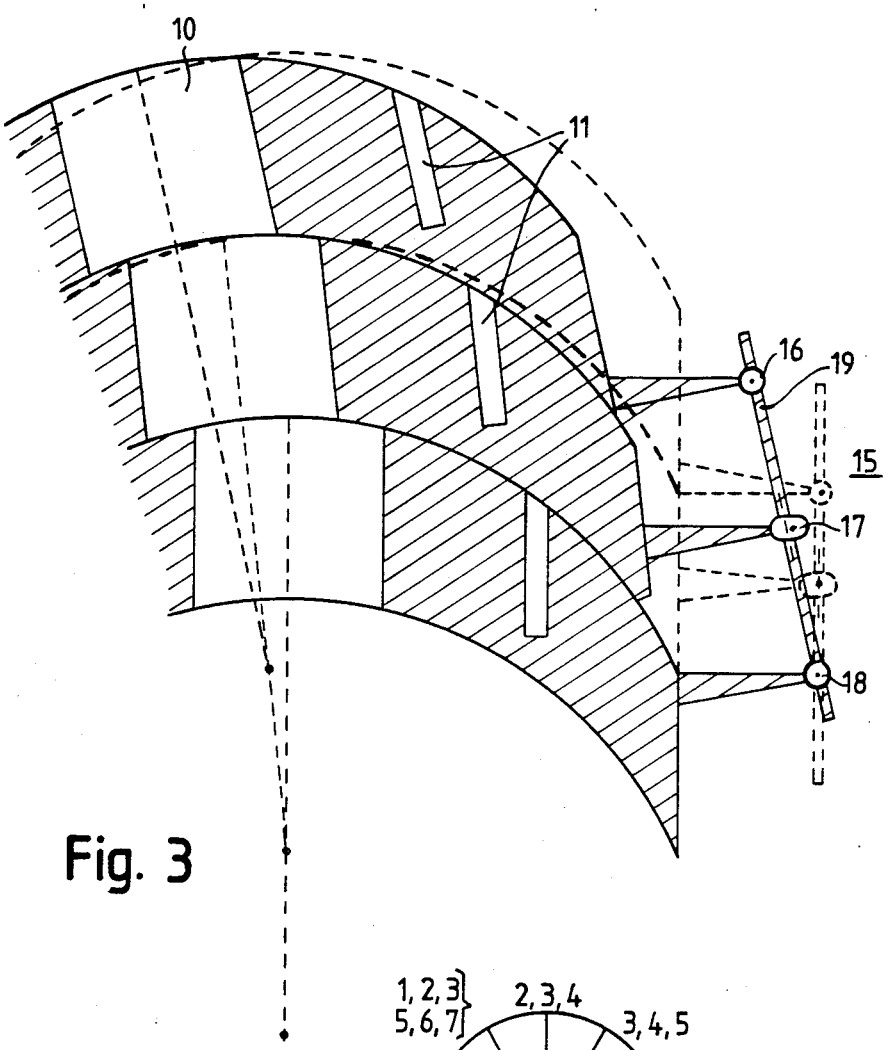
FIG. 3 is a detailed view of the mutual positioning of several consecutive waveguide segments with the coupling mechanism of the embodiment in FIG. 1.

FIG. 3 shows the mutual positioning of three consecutive waveguide segments and the coupling mechanism 15 in more detail. In this figure the three consecutive waveguide segments, when positioned straight above each other, and the coupling mechanism are indicated in this situation by dashed lines. Relative rotation of the waveguide segments causes the ball joints to move along rod 19; this requires the ball joint 17 to have a slight horizontal movability. This is due to the fact that the curved paths, traversed by ball joints 16 and 17 when the top two waveguide segments perform the same rotation with respect to each other and with respect to the bottom waveguide segment as indicated above, are different. In this way, all combinations of three consecutive waveguide segments are provided with a coupling mechanism 15; in the embodiment in question, these are the combinations of waveguide segments 1,2,3; 2,3,4; 3,4,5; 4,5,6 and 5,6,7 in the given sequence. In addition, for each combination of three consecutive waveguide segments three coupling mechanisms are provided at the outside at angles of 120° with respect to each other.

Figure 4:
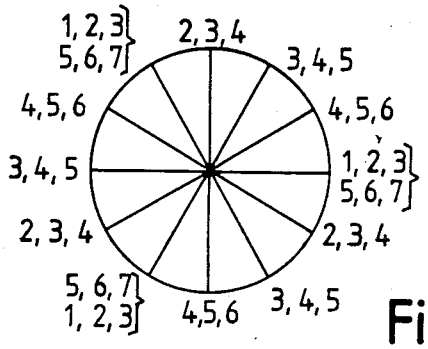
FIG. 4 is a diagram showing the mutual orientation of the coupling mechanisms of the embodiment in FIG. 1.

FIG. 4 shows the mutual orientation of all these coupling mechanisms. The cross section of FIG. 1 indicates the coupling mechanisms for waveguide segments 1,2,3; 3,4,5 and 5,6,7. In a plane, for instance perpendicular to this cross section, the coupling mechanisms are shown for waveguide segments 2,3,4 and 4,5,6.

Figure 5:
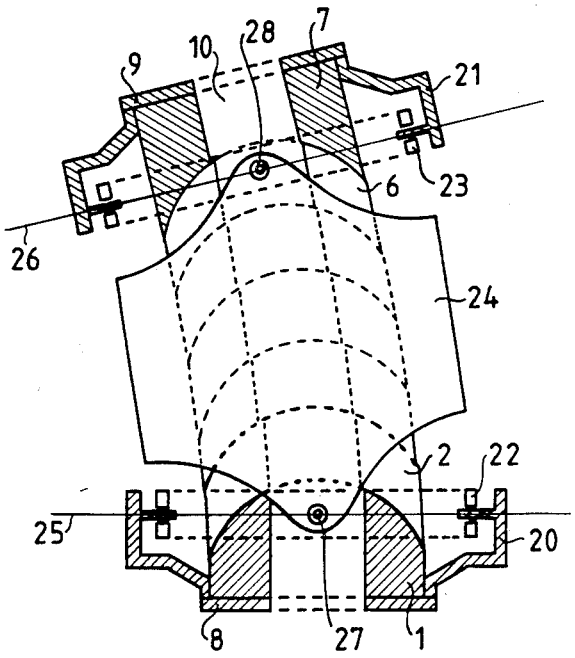
FIG. 5 is a diagram showing how in the first embodiment the universal waveguide joint is incorporated in a kinematically separated disposition in a gimbal system.

The universal waveguide joint of FIG. 1 may very well be applied, althrough not homokinetically, to obtain a flexible waveguide coupler, whereby the rotation of, say, waveguide segment 1 about its axis is transmitted to waveguide segment 7. The universal waveguide joint is thereto incorporated in a special gimbal system, shown only schematically in FIG. 5. This gimbal system comprises two gimbal forks 20 and 21, connected with waveguide segments 1 and 7, and also a gimbal frame which is otherwise kinematically separated from the universal waveguide joint and composed of two gimbal rings 22 and 23 and a connecting element 24. Gimbal ring 22 is rotatable about axis 25 with respect to gimbal fork 20; gimbal ring 23 is rotatable about axis 26 with respect to gimbal fork 21. Connecting element 24 is rotatable about axis 27 with respect to gimbal ring 22 and about axis 28 with respect to gimbal ring 23. In FIG. 5 the connecting element 24 is cylindrical and the universal waveguide joint is partly enveloped. Without the application of such a gimbal system it is not possible to transmit large torques from waveguide segment 1 to waveguide segment 7.

Figure 6:
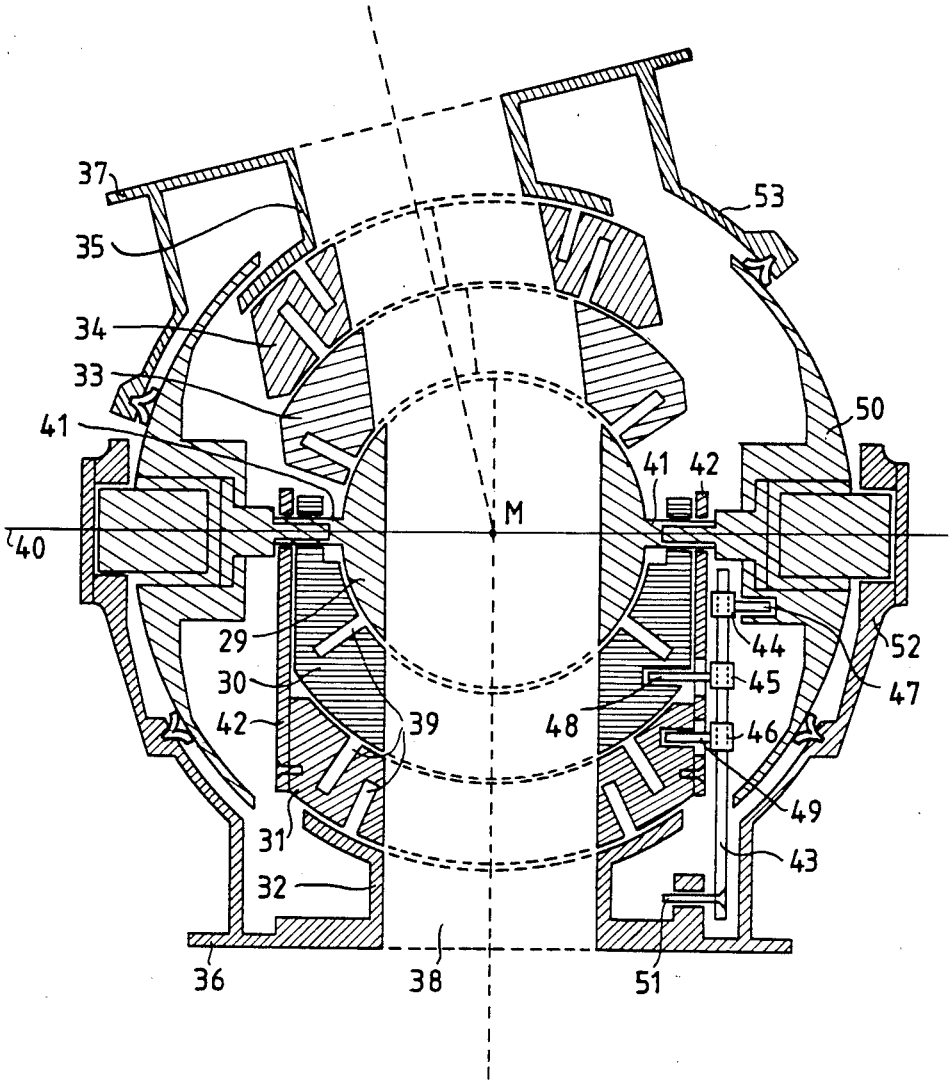
FIG. 6 is a diagram showing a universal waveguide joint in a second embodiment according to the invention, integrated in a gimbal system.

FIG. 6 shows a second embodiment of the universal waveguide joint according to the invention. This joint is fully integrated in the gimbal system, making it suitable to be applied as a flexible coupler. The universal waveguide joint comprises a waveguide segment 29, of which the two opposite ends have a convex surface, allowing other adjoining waveguide segments to slide over this surface. Centre waveguide segment 29 is here of a fully spherical design. In the embodiment in question, the adjoining waveguide segments are designed as a series of three waveguide segments 30, 31, 32 and 33, 34, 35, slidable over each other, at both sides of the centre waveguide segment 29. It will be clear that in principle it suffices to use one segment at both sides of the centre waveguide segment; in such a case, however, the freedom of movement of the waveguide joint is very limited. The curved surfaces are preferred to have a common centre of curvature, situated in the middle M of the centre waveguide segment. The two outer waveguide segments 32 and 35 are again cut square at one end and provided with flanges 36 and 37. Waveguide channel 38 passes through the waveguide segments. If r.f. energy is passed through waveguide channel 38, energy losses may be incurred in this channel, namely at the position of the protruding ridges formed by the spherial surfaces of the waveguide segments displaced with respect to each other. To prevent these energy losses, the separate waveguide segments are provided with chokes 39 in the same way as in the case of the waveguide joint shown in FIG. 1. Instead of applying a single choke in waveguide segments 31, 32 and 34, 35, the embodiment in question contains, for reasons of construction, two chokes in waveguide segments 31 and 34 and none in waveguide segments 32 and 35. This is however of little influence to a proper operation of the waveguide joint.

Waveguide segments 30, 31 and 32 are capable of rotation about an axis 40 with respect to centre waveguide segment 29; waveguide segments 33, 34 and 35 are capable of rotation about a second axis with respect to centre waveguide segment 29. This second axis passes through point M and is perpendicular to axis 40. Consequently, waveguide segments 30–35 may have both a spherical and a cylindrical surface. To obtain a proportional distribution of the total waveguide motion over all waveguide segments, a first and a second coupling mechanism are provided, one to achieve a proportional distribution of the waveguide motion over waveguide segments 29–32 and one to similarly achieve a proportional distribution over waveguide segments 29, 33–35. The coupling mechanisms therefore engage the sides of the first and second series of waveguide segments respectively, are coupled to the centre waveguide segment and are further movable in planes parallel to the respective plane of rotation of the waveguide segments of the first and the second series, respectively, with respect to the centre waveguide segment.

FIG. 6 illustrates the rotation of waveguide segments 30–32 with respect to centre waveguide segment 29 and the design of coupling mechanism in obtaining a proportional distribution of the waveguide movement over waveguide segments 29–32. The coupling mechanism engages the sides of waveguide segments 30–32, is coupled to centre waveguide segment 29 and is rotatable in a vertical plane perpendicular to the plane of the drawing. Waveguide segment 30 is directly rotatable about two axial parts 41 mounted rigidly to the centre waveguide segment. Waveguide segment 31 is rotatable about axial parts 41 by means of connecting members 42 attached rigidly thereto. Waveguide segment 32 is mounted rotatably about axis 40 through the intervention of a gimbal system, with which the waveguide joint forms an integrated whole. This gimbal system is described hereinafter. The coupling mechanism is formed by a rod 43 movable in three bushes 44, 45, 46. These bushes are mounted to the ends of shafts 47, 48 and 49. Shaft 49 is rotatable in a suitable borehole in a gimbal frame 50 connected rigidly with centre waveguide segment 29. Shaft 47 is rotatable in a borehole in waveguide segment 30 and shaft 48 in a borehole in waveguide segment 31. Rod 43 is further rotatably connected to waveguide segment 32 through a pin 51. Through a motion of waveguide segment 32 with respect to waveguide segment 29 the rod 43 rotates in a plane perpendicular to axis of rotation 40, slides through bushes 44, 45, 46 and causes the intermediate waveguide segments 30 and 31 to move at the same time. The position of the boreholes for pins 47, 48, 49 in the respective elements, viz. gimbal frame 50 and waveguide segments 30, 31, is determinative for obtaining a suitable distribution of the waveguide motion over waveguide segments 29–32. This distribution should be such that the reflections against the ridges formed between the separate waveguide segments through relative displacement, compensate each other; in this description this is called a proportional distribution of the waveguide motion over the respective waveguide segments.

Figure 7:
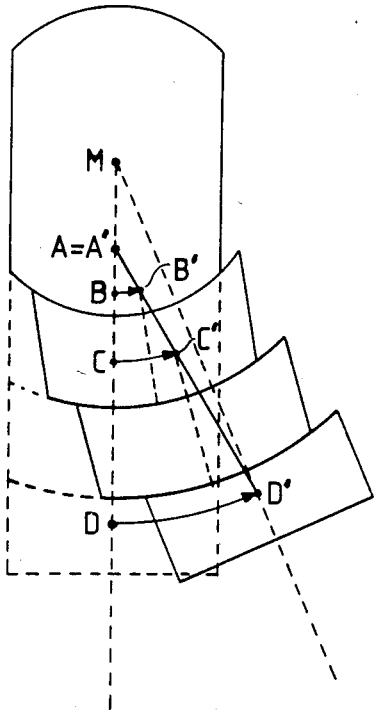
FIG. 7 is a diagram useful in explaining the operation of the coupling mechanism in the universal waveguide joint of FIG. 6.

FIG. 7 illustrates schematically the operation of the coupling mechanism. Shown are the waveguide channel of waveguide segments 29–32, with these segments rotated relative to each other and superimposed straight upon each other, in the latter case by dashed lines. The points of contact of rod 43 to gimbal frame 50 and to waveguide segments 30 and 31, as well as the pivoting point of rod 43 to waveguide segment 32, are indicated by A, B, C and D, respectively, for the case the waveguide segments are superimposed straight upon each other and by A', B', C' and D' for the case the waveguide segments are rotated with respect to each other. Obviously, points A, B, C, D or A', B', C', D' must be on a straight line under all circumstances and it will be clear that, with a certain rotation of waveguide segments 29 and 32 with respect to each other, the extent to which the other waveguide segments are rotated at the same time is determined by the position of the points of contact of rod 43 to these segments.

Figure 8:
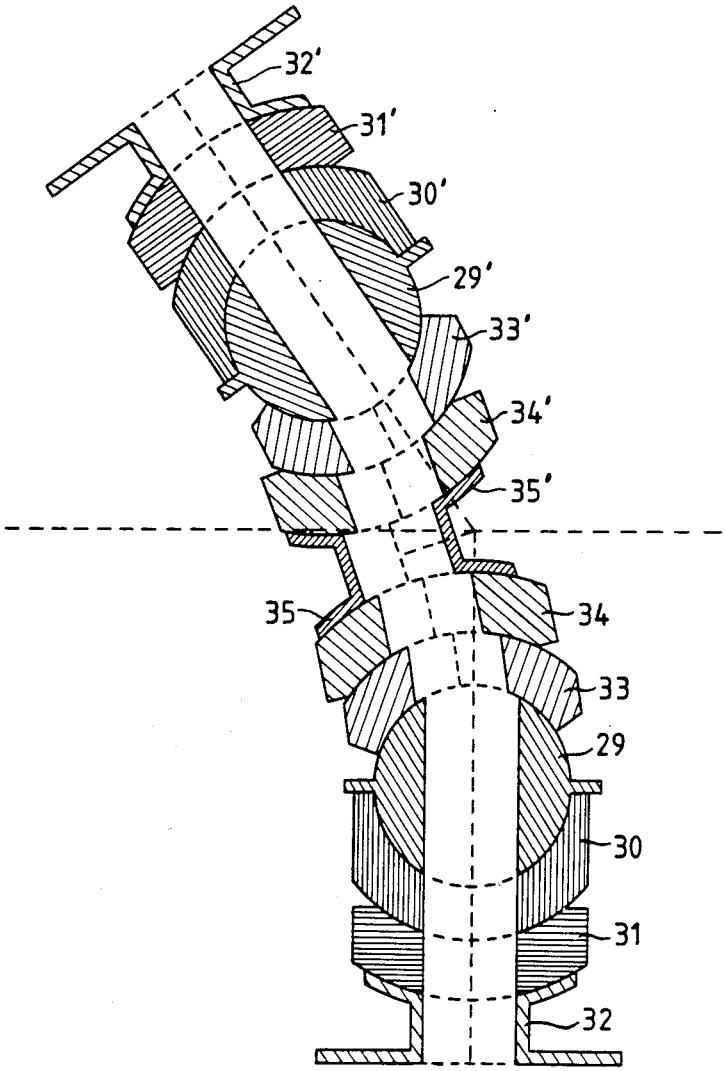
FIGS. 8 and 9 are diagrams showing two embodiments of interconnected universal waveguide joints in the second embodiment to obtain a homokinetic transmission.
Figure 9:
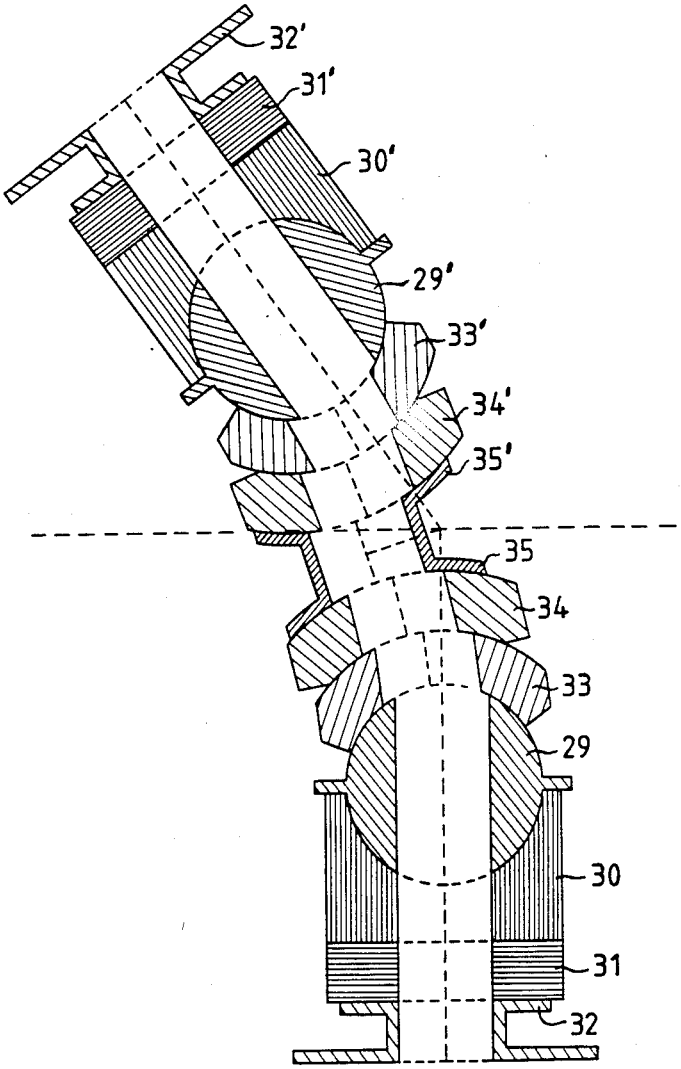

The waveguide joint described with reference to FIG. 6 is integrated in a gimbal system constituted by a gimbal frame 50 rigidly connected to centre waveguide segment 29, and two gimbal forks 52 and 53 rigidly connected to the outer waveguide segments 32 and 35, respectively. Gimbal fork 52 rotates about axis 40 with respect to gimbal frame 50; gimbal fork 53 also rotates about an axis which is perpendicular to axis 40 and passes through point M. Through the integrated whole of waveguide joint and gimbal system a flexible waveguide coupler is obtained, whereby the rotational motion of waveguide segment 32 about the longitudinal axis of the waveguide channel of this segment is transmitted to waveguide segment 35 about the longitudinal axis of the waveguide channel of segment 35. Also in this case, it is not possible to tranmit large torques from waveguide segment 32 to waveguide segment 35 without the application of the gimbal system. The transmission of rotational motion is not homokinetic with a universal motion of waveguide segments 32 and 35 with respect to each other. To achieve this, a second flexible waveguide coupler, which is identical to that illustrated in FIG. 6, is invertedly mounted to the first flexible waveguide coupler shown in FIG. 6. The then obtained homokinetic flexible waveguide coupler is indicated schematically in two embodiments in FIGS. 8 and 9, showing only the applied waveguide segments for the sake of clarity. In the embodiment of FIG. 8, all waveguide segments have spherical surfaces. It is clearly indicated how a flexible waveguide coupler is obtained by superimposing invertedly two identical systems, as illustrated in FIG. 6. As indicated in FIG. 6, the first system comprises waveguide segments 30–35 and the second system waveguide segments 30'–35', where waveguide segments 30, 31', 31, 31', etc. are not only identical, but are also designed to operate in the same way. FIG. 9 shows a second embodiment, in which the waveguide segments, apart from the two centre waveguide segments 29,29', all have cylindrical surfaces. The above described flexible waveguide coupler may be applied to advantage in an arrangement for a vehicle- or vessel-borne surveillance radar antenna, as described in EP-A- No. 0.147.900, namely to replace the universal waveguide joint applied in this arrangement and shown in detail in FIG. 4 of the cited patent application.

Figure 10:
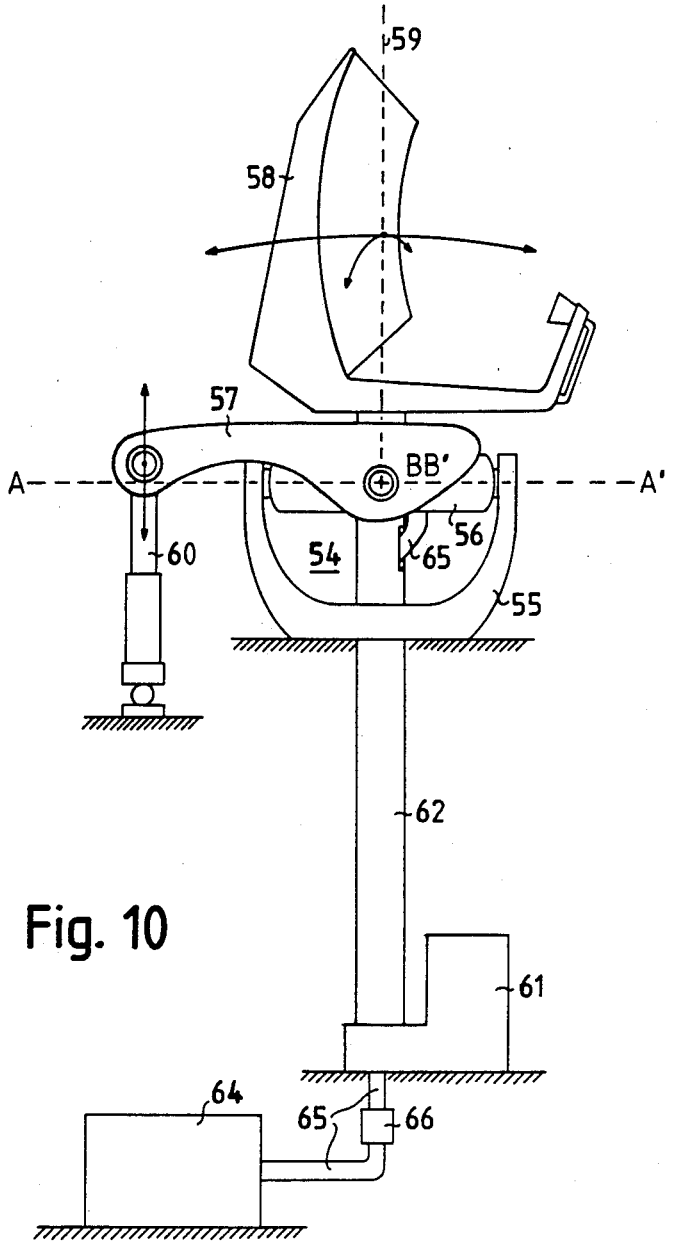
FIG. 10 is a diagram showing an arrangement for a surveillance radar antenna, which requires the application of universal waveguide joints.

FIG. 10 is a diagram showing the arrangement of such a surveillance radar antenna. This arrangement comprises a two-axis, vehicle- or vessel-borne gimbal system 54, consisting of a yoke 55 and a gimbal ring 56. Ring 56 is capable of rotation in yoke 55 about axis AA'. The arrangement is further provided with a platform 57 suspended in gimbal system 54. Platform 57, jointly with ring 56, is capable of rotation about axis AA', while the platform is further rotatable about axis BB' with respect to gimbal ring 56. The two axes of gimbal system 54 are mutually orthogonal. Platform 57 can be stabilised about these two axes with respect to an earth-fixed reference position. Surveillance radar antenna 58 is rotatable about an axis 59 perpendicular to platform 57. The arrangement further comprises two linear actuators, of which only actuator 60 is shown in FIG. 10. These linear actuators are mounted directly on the vehicle or vessel, but engage platform 57. Through a mutually, equally directed parallel motion the linear actuators cause a rotation of platform 57 about axis BB'; through a mutually, opposite motion they cause a rotation of platform 57 jointly with gimbal ring 56 about axis AA'. The platform is servo-controlled by the two linear actuators in a conventional way and is slaved to a gyro-determined reference position, specially to a horizontal plane.

The vehicle or vessel carries the actuator 61 for the surveillance radar antenna. On the surveillance radar antenna the rotational motion produced by actuator 61 is transmitted through rotation shaft 62 and a universal joint 63 explained in more detail in FIG. 12. Further, means are required to transmit the r.f. energy between a transmitting and receiving unit 64, mounted directly on the vehicle or vessel, and the radar antenna 58. The waveguide channel incorporated for this purpose comprises, in addition to a waveguide 65 and a rotary waveguide coupler 66, a flexible waveguide coupler in the gimbal system 54.

Figure 11:
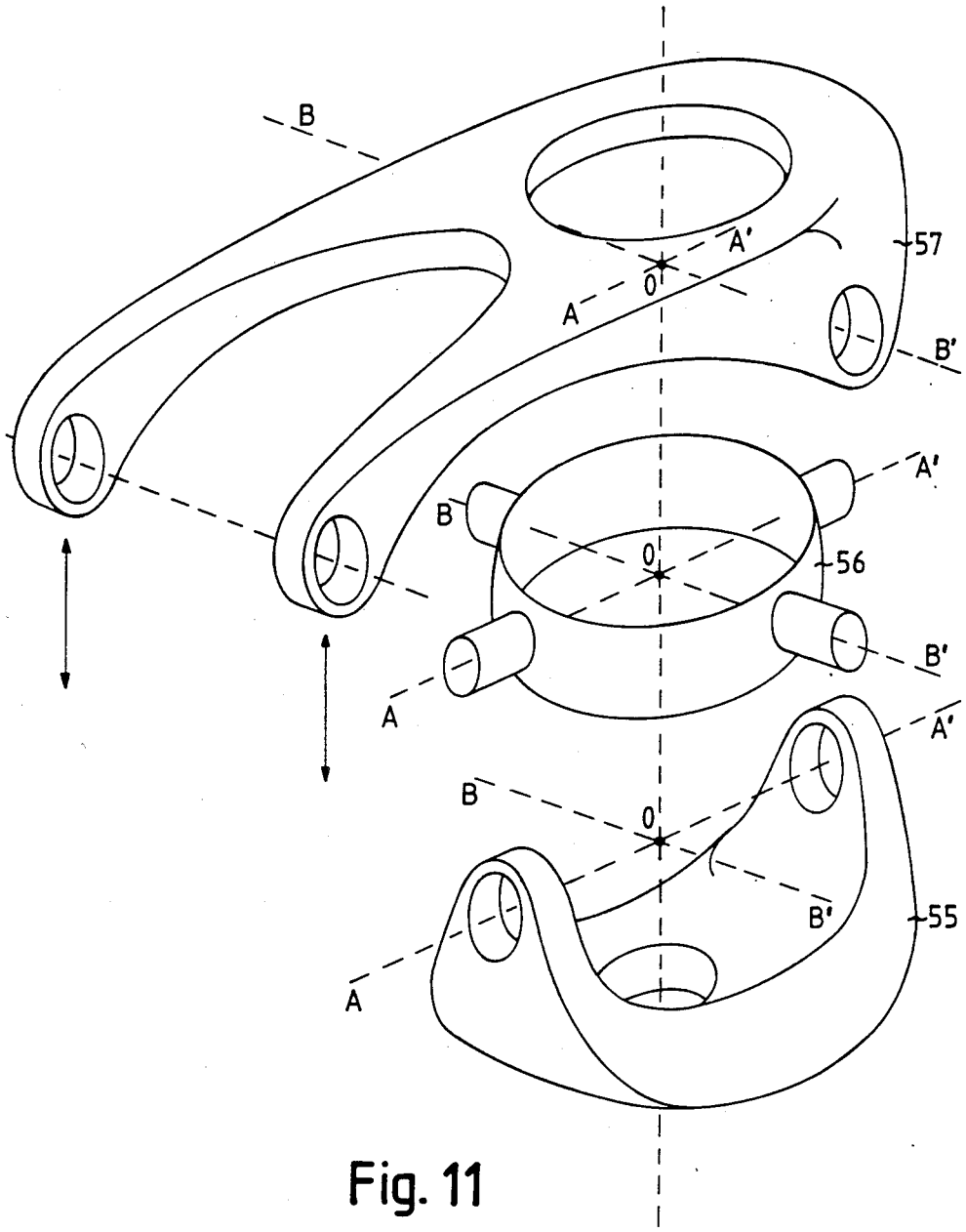
FIG. 11 shows the freedom of movement of the platform in the gimbal system of the arrangement of FIG. 10.

FIG. 11 shows the freedom of movement of platform 57 about axes AA' and BB' in gimbal system 54. For the sake of simplicity, yoke 55, gimbal ring 56 and platform 57 are shown in a position vertically displaced with respect to each other.

Figure 12:
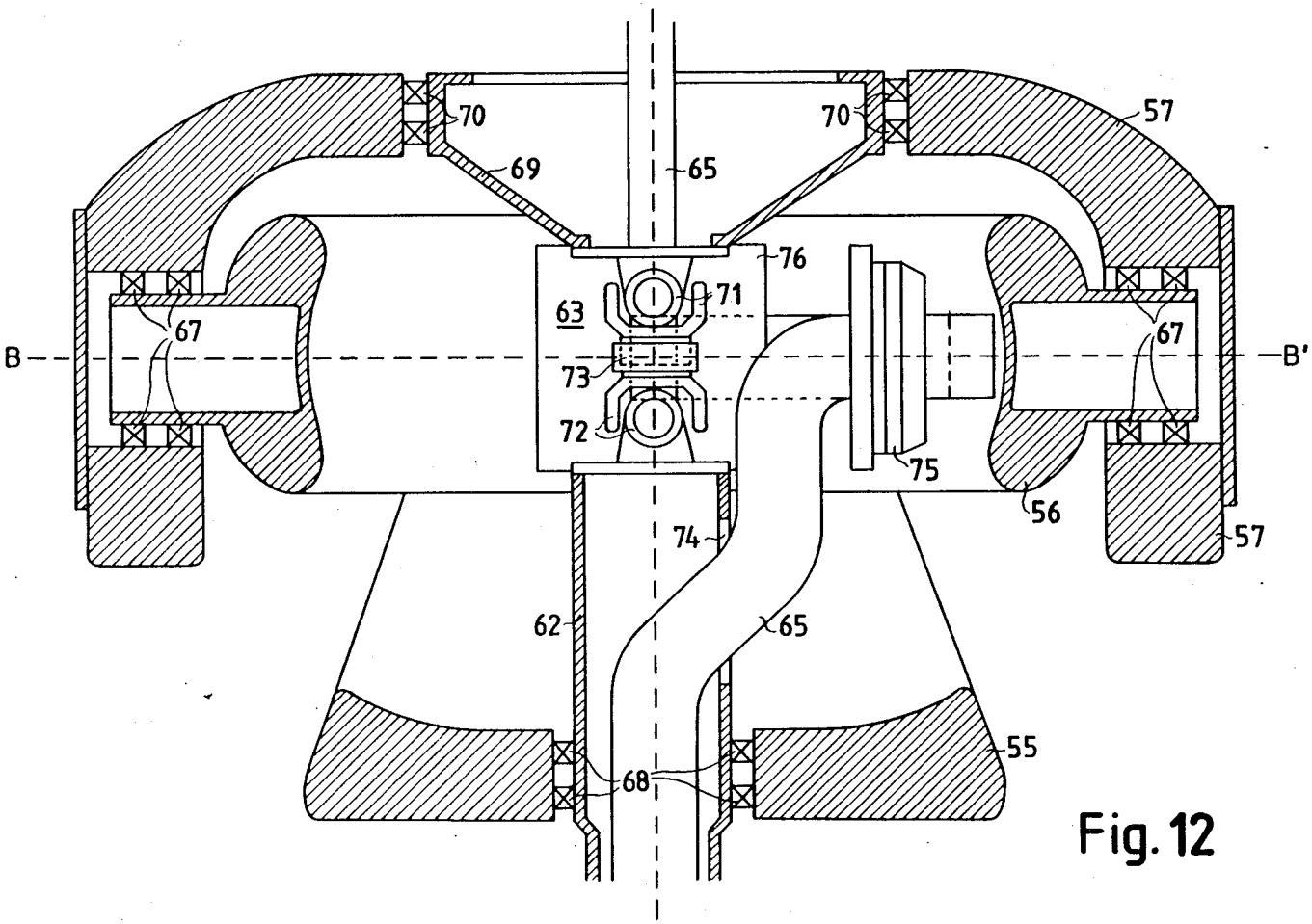
FIG. 12 is a cross section of the arrangement for the surveillance radar antenna, incorporating a universal waveguide joint according to the state of the art.

FIG. 12 is a cross sectional view of the arrangement in a plane perpendicular to FIG. 10; rotation axis BB' therefore lies in the plane of the figure. FIG. 12 shows again yoke 55, gimbal ring 56 and platform 57. Bearing 67 permits platform 57 to rotate about axis BB' with respect to gimbal ring 56. Bearing 68 enables rotation shaft 62 to rotate in a hole at the centre of yoke 55. A bearing 70 permits frame 69 of the surveillance radar antenna to rotate in a hole at the centre of platform 57. Frame 69 is connected to shaft 62 through the mechanical, universal joint 63. This is a homokinetic joint comprising, in the embodiment in question, two universal joints 71 and 72 and a connecting piece 73 variable in the longitudinal direction. The connecting part 73 is adapted to compensate for variations in length in the mechanical transmission during the motion of platform 57 with respect to yoke 55. The resulting, mutually orthogonal axes of rotation of coupling 63 lie in the plane through axes AA' and BB' and rotate in this plane when the surveillance apparatus performs its rotational motion.

FIG. 12 also shows waveguide 65, which passes through the rotation shaft 62, leaves this shaft through opening 74, and bypasses joint 63 via a flexible waveguide coupler to pass to radar antenna 58 via frame 69. Also the mutually orthogonal axes of rotation of the universal waveguide joint lie in the plane through axes AA' and BB' and rotate in this plane when the radar antenna performs its rotational motion. The freedom of rotation of the waveguide joint is achieved by stepped twisters 75 and 76. This combination of stepped twisters form however no homokinetic coupling. Should however a uniform waveguide motion be required, a flexible piece of waveguide is incorporated in the waveguide part bypassing the mechanical joint. Another solution could be obtained by inserting another stepped twister in the waveguide part in the up or down direction. A variation in length, as in the mechanical transmission, is not incurred in this application.

Figure 13:
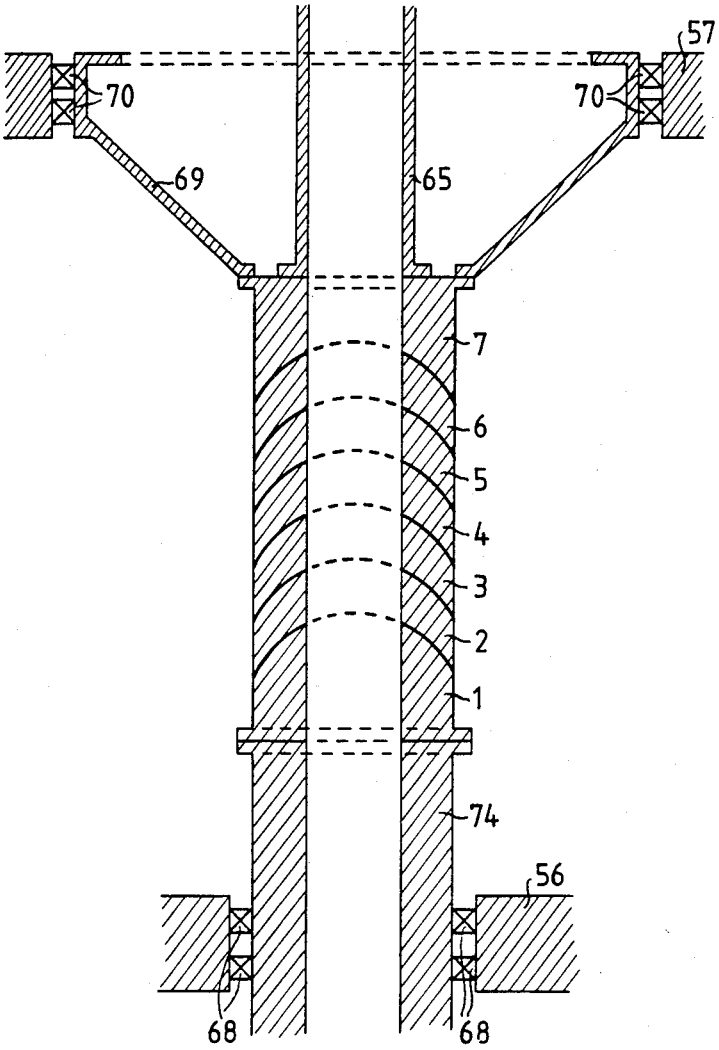
FIG. 13 is a fragmentary cross section of the arrangement for the surveillance radar antenna, incorporating a universal waveguide joint according to the first embodiment, the associated gimbal system of this waveguide joint being omitted for reasons of simplicity.
Figure 14:
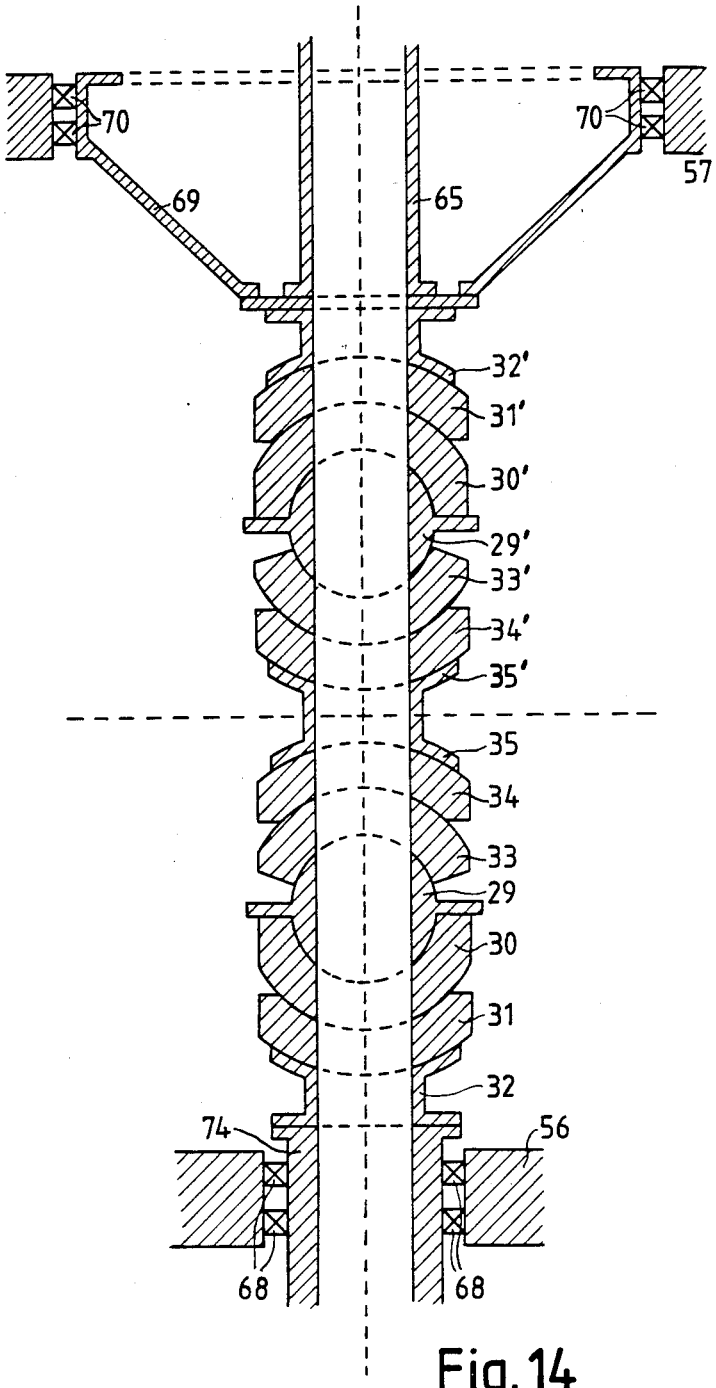
FIG. 14 is a fragmentary cross section of the arrangement for the surveillance radar antenna, incorporating two universal waveguide joints to obtain a homokinetic transmission, the associated gimbal systems of these waveguide joint being omitted for the sake of simplicity.

FIGS. 13 and 14 indicate how the flexible waveguide couplers in their two embodiments can be incorporated in the arrangement described above. For the sake of clarity, only the different waveguide segments are illustrated, while the accompanying gimbal elements have been omitted. The outer waveguide segments of the flexible waveguide coupler form a flanged connection with frame 69 of the surveillance radar antenna and with the rotation shaft attached to waveguide 74. The use of the flexible waveguide couplers according to the invention dispense with the need of a universal waveguide joint designed as bypass of the mechanical, universal joint. Rotation shaft 62 and waveguide 65, designed to operate separately, although concentrically with respect to each other, as shown in FIG. 10, may also be designed jointly as one complete assembly 74. To be able to compensate for length variations in the mechanical transmission connected with r.f. energy transmission during the motion of platform 57 with respect to yoke 55, it is advisable to include an axially movable element in the complete assembly 74.

We claim:

1. A universal waveguide joint comprising at least three consecutive waveguide segments slidable over each other at abutting concave-spherical and convex-spherical end surfaces, the curvatures in said at least three segments being oriented in the same direction.

2. A universal waveguide joint as claimed in claim 1, characterised in that the waveguide segments all have a spherical surface with the same radius of curvature.

3. A universal waveguide joint as claimed in claim 1 or 2, characterised in that the waveguide segments are mutually identical, excepting the two outer segments.

4. A universal waveguide joint as claimed in claim 1 or 2, characterised in that the outer surface of the side of the waveguide segments is cylindrical.

5. A universal waveguide joint as claimed in claim 1 or 2, characterised in that coupling mechanisms are incorporated, each of which coupling mechanisms engages with the sides of three consecutive waveguide segments, for obtaining a proportional distribution of the total waveguide movement over the consecutive combinations of each two waveguide segments slidable over one another.

6. A universal waveguide joint as claimed in claim 5, characterised in that the coupling mechanism is constituted by three ball joints located at equal distances from the sides of three consecutive waveguide segments and connected to said sides and by a connecting rod passing through said ball joints, the centre ball joint being fitted at the height of the centre of the side in the middle of the three consecutive waveguide segments and the two other ball joints being at equal distances from the centre ball joint.

7. A universal waveguide joint as claimed in claim 1 where at least one of the waveguide segments at the two opposite ends has a convex surface and as such forms a centre waveguide segment, and where at least first and a second waveguide segments are slidable over respective ones of said convex surfaces such that the first waveguide segment is rotatable about a first axis and the second waveguide segment about a second axis perpendicular to said first axis.

8. A universal waveguide joint as claimed in claim 7, characterised in that the respective surfaces are spherical.

9. A universal waveguide joint as claimed in claim 7, characterised in that the respective surfaces are cylindrical.

10. A universal waveguide joint as claimed in claim 7, 8 or 9, characterised in that the curved surfaces all have a common centre of curvature lying in the middle of the centre waveguide segment.

11. A universal waveguide joint as claimed in claim 7, 8 or 9 where a first and a second series of at least two waveguide segments are incorporated, all of the first series of waveguide segments being rotatable about the first axis with respect to the centre waveguide segment and all of the second series of waveguide segments being rotatable about the second axis with respect to the centre waveguide segment, and where first and a second coupling mechanisms are incorporated for obtaining a proportional distribution of the total waveguide movement over all waveguide segments, said first and second coupling mechanisms engaging with the sides of the waveguide segments of the first and the second series, respectively, being coupled with the centre waveguide segment, and being movable in planes parallel to the respective rotational plane of the waveguide segments of the first and the second series, respectively, with respect to the centre waveguide segment.

12. A flexible waveguide coupler comprising a gimbal system having a universal waveguide joint including at least two waveguide segments slidable over each other, characterized in that one end of at least one of the waveguide segments has a convex surface and the end of another respective waveguide segment, slidable over said convex surface, has a concave surface.

13. A flexible waveguide coupler as claimed in claim 12, characterised in that the gimbal system includes two gimbal forks which are connected to two outer waveguide segments of the universal waveguide joint, while the gimbal system is otherwise isolated kinematically from the universal waveguide joint.

14. A flexible waveguide coupler as claimed in claim 12, characterised in that the gimbal system includes two gimbal forks which are connected to two outer waveguide segments of the universal waveguide joint, while the gimbal system and the universal waveguide joint are fully integrated with each other.

15. A flexible waveguide coupler comprising a universal waveguide joint comprising at least two waveguide segments slidable over each other, characterized in that one end of at least one of the waveguide segments has a convex surface and the end of another respective waveguide segment, slidable over said convex surface, has a concave surface, the rotational motion of one of the waveguide segments about its axis being tramsmitted to the other waveguide segment, and including a gimbal system into which the universal waveguide joint is integrally incorporated, the gimbal system having two gimbal forks which are connected to the two waveguide segments of the universal waveguide joint, characterized in that two of said universal waveguide joints are interconnected for obtaining a homokinetic transmission.

16. An arrangement for a vehicle- or vessel-borne surveillance radar antenna, provided with a two-axis gimbal system mounted on the vehicle or vessel and with a platform suspended by said gimbal system, which platform can be stabilised with respect to an earth-fixed reference position, where the surveillance radar antenna is rotatable about an axis perpendicular to the platform, while a universal mechanical joint is incorporated for transmitting the rotational motion produced by a drive mechanism directly mounted on the vehicle or vessel, to the surveillance radar antenna, where a universal waveguide joint is included in the waveguide channel for the r.f. -energy transport between a transmitting and receiving unit, mounted on the vehicle or vessel, and the antenna, the orthogonal axes of which joints are movable in the plane through the axes of the gimbal system, where said universal waveguide joint comprises a gimbal system having a universal waveguide joint including at least two waveguide segments slidable over each other, and where one end of at least one of the waveguide segments has a convex surface and the end of another respective waveguide segment, slidable over said convex surface, has a concave surface.

* * * * *